US010712097B2

(12) United States Patent
Takami et al.

(10) Patent No.: US 10,712,097 B2
(45) Date of Patent: Jul. 14, 2020

(54) OFFSET FIN AND HEAT EXCHANGER HAVING SAME

(71) Applicant: Panasonic Intellectual Property Management Co., Ltd., Osaka (JP)

(72) Inventors: Fuminori Takami, Osaka (JP); Yasuhiro Asaida, Kyoto (JP); Satoaki Hojo, Osaka (JP); Terutsugu Segawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 177 days.

(21) Appl. No.: 15/307,249

(22) PCT Filed: Apr. 24, 2015

(86) PCT No.: PCT/JP2015/002218

§ 371 (c)(1),
(2) Date: Oct. 27, 2016

(87) PCT Pub. No.: WO2015/170456

PCT Pub. Date: Nov. 12, 2015

(65) Prior Publication Data

US 2017/0051982 A1 Feb. 23, 2017

(30) Foreign Application Priority Data

May 9, 2014 (JP) ..... 2014-098018
Feb. 27, 2015 (JP) ..... 2015-039356

(51) Int. Cl.
*F28D 9/00* (2006.01)
*F28F 3/06* (2006.01)
(Continued)

(52) U.S. Cl.
CPC ..... *F28D 9/0093* (2013.01); *F28D 1/05366* (2013.01); *F28D 9/005* (2013.01);
(Continued)

(58) Field of Classification Search
CPC .... F28D 9/0093; F28D 9/005; F28D 1/05366; F28F 1/128; F28F 3/027; F28F 3/08; F28F 3/06
See application file for complete search history.

(56) References Cited

U.S. PATENT DOCUMENTS 4,781,248 A 11/1988 Pfeiffer
6,138,354 A * 10/2000 Kobayashi ..... B21D 13/045 29/890.049
(Continued)

FOREIGN PATENT DOCUMENTS

JP 52-054957 U 4/1977
JP 63-025494 2/1988
(Continued)

OTHER PUBLICATIONS

International Search Report of PCT application No. PCT/JP2015/002218 dated Jun. 23, 2015.

*Primary Examiner* — Devon Russell
(74) *Attorney, Agent, or Firm* — Panasonic IP Management; Kerry S. Culpepper

(57) ABSTRACT

An offset fin for use in a heat exchanger includes a first corrugation structure and a second corrugation structure. The first corrugation structure includes a plurality of first fins aligned in a first direction. The second corrugation structure includes a plurality of second fins aligned in the first direction. The second corrugation structure is disposed in a second direction orthogonal to the first direction, with respect to the first corrugation structure. The first fins and the second fins protrude alternately in a third direction orthogonal to both the first direction and the second direction, and each have a protruding shape cross-section. In the first direction, the second fins are disposed offset from the first fins. Each of the first fins includes a first side wall inclined with respect to the second direction, and each of the second fins includes a second side wall inclined with respect to the second direction, at a side opposite to a side at which the first side wall is inclined.

5 Claims, 15 Drawing Sheets

(51) Int. Cl.

| | |
|---|---|
| ***F28F 1/12*** | (2006.01) |
| ***F28D 1/053*** | (2006.01) |
| ***F28F 3/02*** | (2006.01) |
| ***F28F 3/08*** | (2006.01) |

(52) U.S. Cl.
CPC ..... *F28F 1/128* (2013.01); *F28F 3/027* (2013.01); *F28F 3/06* (2013.01); *F28F 3/08* (2013.01)

(56) References Cited

U.S. PATENT DOCUMENTS

2007/0119581 A1* 5/2007 Kato ..... F28D 1/0391 165/177
2008/0011464 A1 1/2008 Oofune et al.
2008/0264616 A1* 10/2008 Deschodt ..... F28D 9/0068 165/152
2009/0090497 A1* 4/2009 Knaus ..... B21D 53/02 165/182
2012/0193077 A1* 8/2012 Choi ..... F28F 3/027 165/109.1
2015/0047818 A1* 2/2015 Peskos ..... F28D 9/0037 165/166
2015/0198372 A1* 7/2015 Desikan ..... F28D 1/0366 165/151

FOREIGN PATENT DOCUMENTS

JP 1-170881 U 12/1989
JP 5-096773 U 12/1993
JP 2007-183071 7/2007
JP 2008-039380 2/2008
JP 2009-299968 12/2009

* cited by examiner

OFFSET FIN AND HEAT EXCHANGER HAVING SAME

CROSS-REFERENCE TO RELATED APPLICATIONS

This application is a U.S. national stage application of the PCT International. Application No. PCT/JP2015/002218 filed on Apr. 24, 2015, which claims the benefit of foreign priority of Japanese patent applications 2014-098018 filed on May 9, 2014 and 2015-039356 filed on Feb. 27, 2015, the contents all of which are incorporated herein by reference.

TECHNICAL FIELD

The present disclosure relates to a heat exchanger for transferring heat between fluids and, more particularly, to an offset fin and a heat exchanger having the offset fin.

BACKGROUND

Various structures have been known for an offset fin used in a heat exchanger (see, for example, Unexamined Japanese Patent Publication No. 2008-39380). A structure of conventional offset fin 50 will be described with reference to FIG. 16.

Offset fin 50 is formed of a plurality of corrugation structures 60, 70. Each of corrugation structures 60 includes a plurality of fins 61 each having a protruding shape in cross-section. Each of corrugation structures 70 includes a plurality of fins 71 each having a protruding shape in cross-section. The plurality of corrugation structures 60, 70 are arranged in a direction orthogonal to flow direction D of a fluid. Corrugation structure 70 is disposed adjacent to and downstream of corrugation structure 60 in flow direction D.

Fins 61, 71 are each formed by bending a sheet of metal. Fins 61, 71 are each arranged to protrude in an upward direction in FIG. 16 at a constant pitch. Fins 61, 71 are arranged at an equal pitch. A position of fin 71 (a position in a direction in which the corrugation structures extend) is offset (disposed offset) from a position of fin 61.

Side walls 62, 72 of fins 61, 72 are parallel to a direction along flow direction D of a fluid, that is, flow direction D of a fluid. With offset fin 50 of this structure mounted to a heat exchanger, when a fluid flows in flow direction D, heat is transferred between side walls 62, 72 of fins 61, 71 and the fluid when the fluid passes through fins 61, 71. Turbulence occurs in the fluid because corrugation structure 70 is disposed offset from corrugation structure 60. An acceleration effect produced by the turbulence increases a heat transfer rate.

SUMMARY

A heat exchanger is required to increase a heat transfer rate while providing for a low pressure drop of a passing fluid. The present disclosure provides a heat exchanger having an offset fin. More particularly, the present disclosure provides a heat exchanger and an offset fin for the heat exchanger which increase a heat transfer rate while providing for a low pressure drop of a fluid.

In order to achieve the object, the heat exchanger and the offset fin for the heat exchanger of the present disclosure are structured as follows.

An offset fin according to an aspect of the present disclosure includes a first corrugation structure and a second corrugation structure. The first corrugation structure includes a plurality of first fins aligned in a first direction. The second corrugation structure includes a plurality of second fins aligned in the first direction. The second corrugation structure is disposed in a second direction orthogonal to the first direction, with respect to the first corrugation structure. The first fins and the second fins protrude alternately in a third direction orthogonal to both the first direction and the second direction, and each have a protruding shape in cross-section. In the first direction, the second fins are disposed offset from the first fins. Each of the first fins includes a first side wall inclined with respect to the second direction, and each of the second fins includes a second side wall inclined with respect to the second direction, at a side opposite to a side at which the first side wall is inclined.

The heat exchanger according to the aspect of the present disclosure includes a first fluid passage, a second fluid passage, and the above-described offset fin disposed between the first fluid passage and the second fluid passage.

The present disclosure enables a heat exchanger having an offset fin to increase a heat transfer rate while providing for a low pressure drop of a fluid.

DESCRIPTION OF EMBODIMENTS

Figure 1:
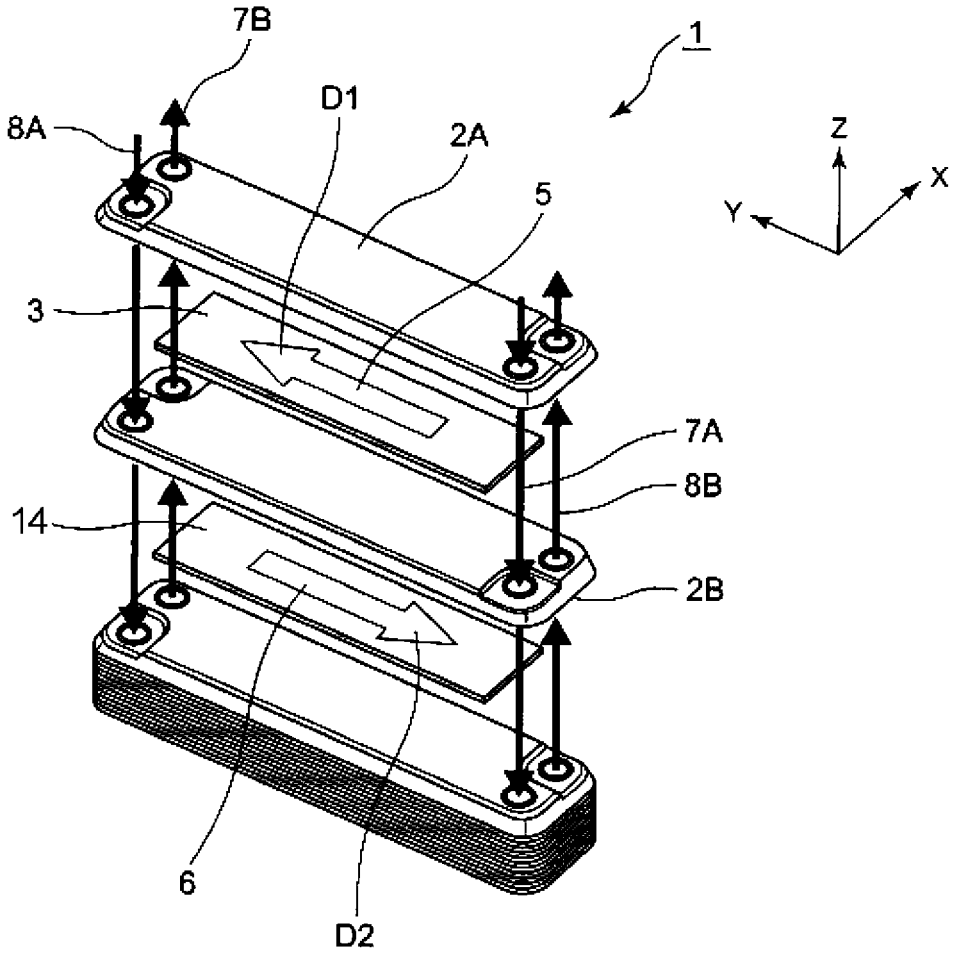
FIG. 1 is an exploded perspective view of a heat exchanger according to a first exemplary embodiment of the present disclosure.

Prior to the description of exemplary embodiments of the present disclosure, disadvantages with the conventional heat exchanger will be briefly described. In conventional offset fin 50, side walls 62, 72 of fins 61, 71 are disposed parallel to flow direction D of a fluid. This structure allows a fluid to flow substantially linearly, resulting in a low pressure drop of the fluid. However, since the fluid flows substantially linearly, a passage where heat is transferred is short. Additionally, it is difficult to increase a heat transfer rate because heating surface areas of fins 61, 71 which contribute to the heat transfer with the fluid are small. Further, since the fluid flows substantially linearly, there is a limit to a turbulence acceleration effect on the fluid produced by offsetting second corrugation structure 70 from first corrugation structure 60, making it difficult to further increase the heat transfer rate.

The exemplary embodiments of the present disclosure will be described below in detail with reference to the accompanying drawings.

First Exemplary Embodiment

FIG. 1 is an exploded perspective view of heat exchanger 1 according to a first exemplary embodiment of the present disclosure, heat exchanger 1 having first fluid offset fin (hereinafter "offset fin") 3 and second fluid offset fin (hereinafter "offset fin") 14. Note that FIG. 1 illustrates a main structure of heat exchanger 1, so that a structure of heat exchanger 1 is partially illustrated.

Heat exchanger 1 is a plate heat exchanger. In heat exchanger 1, a passage through which a fluid flows is formed between a plurality of stacked plates, and heat is transferred between a first fluid and a second fluid through passages adjacent in a direction in which the plates are stacked. The first fluid and the second fluid may be a liquid or a gas.

Heat exchanger 1 includes two types of plates 2A, 2B which are alternately stacked, offset fin 3 disposed between a lower surface of plate 2A and an upper surface of plate 2B, and offset fin 14 disposed between a lower surface of plate 2B and an upper surface of plate 2A. Outer edges surrounding offset fins 3, 14 between plates 2A, 2B are joined together (e.g., by brazing). This allows first fluid passage 5 to be defined by the lower surface of plate 2A, the upper surface of plate 2B, and offset fin 3. Second fluid passage 6 is defined by the lower surface of plate 2B, the upper surface of plate 2A, and offset fin 14. Instead of joining plates 2A, 2B as described above, a sealing member may be disposed at the outer edges between plates 2A, 2B. As described above, heat exchanger 1 includes first fluid passage 5, second fluid passage 6, and offset fin 3 disposed between first fluid passage 5 and second fluid passage 6.

At one edges of plates 2A, 2B in their longitudinal direction, first fluid supply passage (hereinafter "supply passage") 7A and second fluid outlet passage (hereinafter "outlet passage") 8B are provided through plates 2A, 2B in a direction in which plates 2A, 2B are stacked. Similarly, at the other edges of plates 2A, 2B in their longitudinal direction, first fluid outlet passage (hereinafter "outlet passage") 7B and second fluid supply passage (hereinafter "supply passage") 8A are provided. Supply passage 7A and outlet passage 7B communicate with first fluid passage 5, and supply passage 8A and outlet passage 8B communicate with second fluid passage 6.

In heat exchanger 1 having the above structure, a first fluid and a second fluid are each caused to flow through a corresponding fluid passage. The first fluid flows through first fluid passage 5 in flow direction D1 (i.e., a direction from the one edges toward the other edges). The second fluid flows through second fluid passage 6 in flow direction D2 (i.e., a direction from the other edges toward the one edges). These flows of the first fluid and the second fluid allow heat to be transferred between the first fluid and the second fluid via plates 2A, 2B and offset fins 3, 14.

Structures of offset fins 3, 14 used in heat exchanger 1 will now be described. Only a structure of offset fin 3 will be described below because the structure of offset fin 14 may be identical to the structure of offset fin 3. In the description below, the first fluid and the second fluid are simply referred to as "fluid" when no distinction is made between the first fluid and the second fluid.

Figure 2:
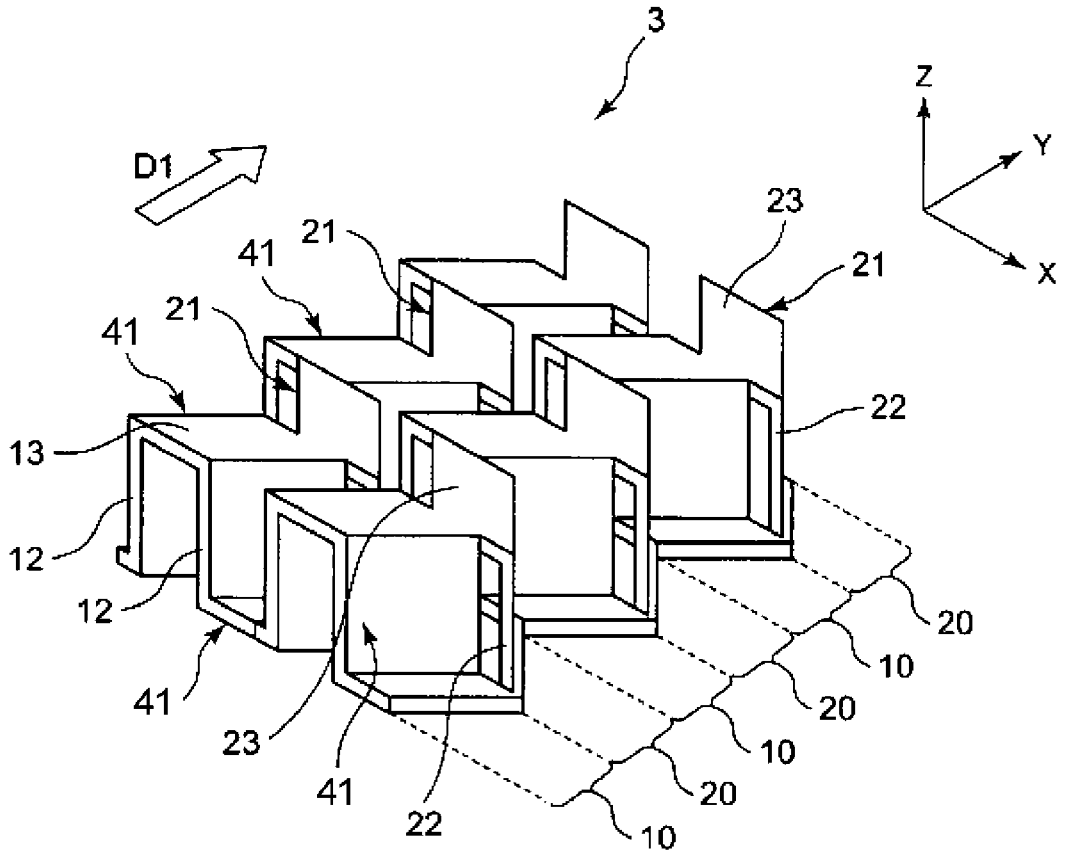
FIG. 2 is an enlarged partial perspective view of an offset fin included in the heat exchanger illustrated in FIG. 1.

FIG. 2 is an enlarged partial perspective view of offset fin 3. Offset fin 3 includes corrugation structure 10, which is a first corrugation structure, and corrugation structure 20, which is a second corrugation structure. Corrugation structure 10 includes a plurality of fins (first fins) 41 aligned in the X direction. Corrugation structure 20 includes a plurality of fins (second fins) 21 aligned in the X direction. Corrugation structure 20 is disposed in the Y direction, with respect to corrugation structure 10. Fins 41, 21 protrude alternately in the Z direction, and each have a protruding shape in cross-section. In the X direction, fins 21 are disposed offset from fins 41. The Y direction is a second direction orthogonal to the X direction, which is a first direction, and the Z direction is a third direction orthogonal to both the X direction and the Y direction.

Fins 41 each include first side wall (hereinafter "side wall") 12 inclined with respect to the Y direction, and fins 21 each include second side wall (hereinafter "side wall") 22 inclined with respect to the Y direction, at a side opposite to a side at which side wall 12 is inclined. Offset fin 3 is constituted by a plurality of corrugation structures 10, 20 arranged in the Y direction.

The Z direction is the direction in which plates 2A, 2B are stacked in heat exchanger 1. In this exemplary embodiment, a direction in which corrugation structures 10, 20 extend is the X direction, and the Y direction is flow direction D1 of a fluid.

In corrugation structure 10, which is one of the plurality of corrugation structures included in offset fin 3, a plurality of fins 41, each formed by bending a sheet of metal and having a protruding shape in cross-section, for example, are arranged at a constant pitch in the X direction so as to alternately protrude at positive orientation and negative orientation in the Z direction. Corrugation structure 20 is disposed adjacent to and downstream of corrugation structure 10 in flow direction D1 of a fluid. Corrugation structure 20 has a structure similar to the structure of corrugation structure 10. In corrugation structure 20, a plurality of fins 21 are arranged at a constant pitch in the X direction so as to alternately protrude at positive orientation and negative orientation in the Z direction.

In corrugation structure 10 and corrugation structure 20, a pitch of fins 41 in the X direction is identical to a pitch of fins 21 in the X direction. In the X direction, fins 21 are offset from fins 41. That is, in the X direction, fins 21 are disposed offset from fins 41.

Second corrugation structure 10 is disposed adjacent to and downstream of corrugation structure 20 in flow direction D1 of a fluid, and second corrugation structure 20 is disposed adjacent to and downstream of second corrugation structure 10. That is, in offset fin 3, corrugation structures 10 and corrugation structures 20 are disposed adjacent to each other along flow direction D1 of a fluid.

Figure 3:
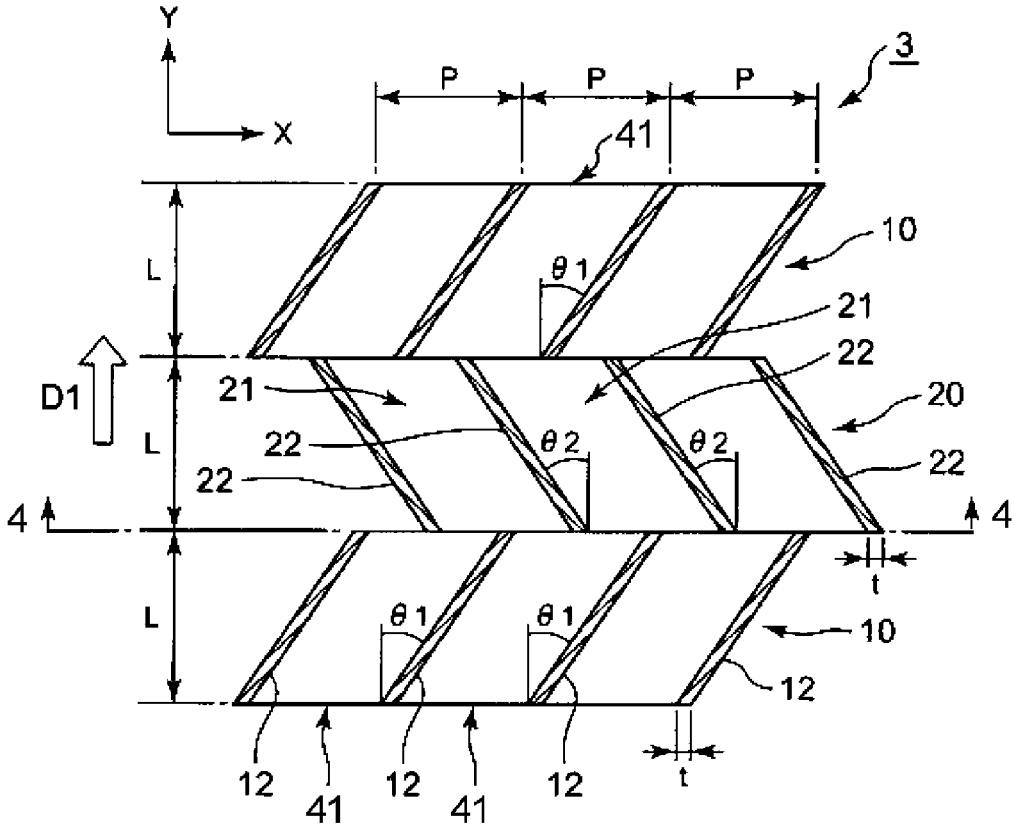
FIG. 3 is a cross-sectional view of the offset fin illustrated in FIG. 2, taken in the XY-plane.
Figure 4:
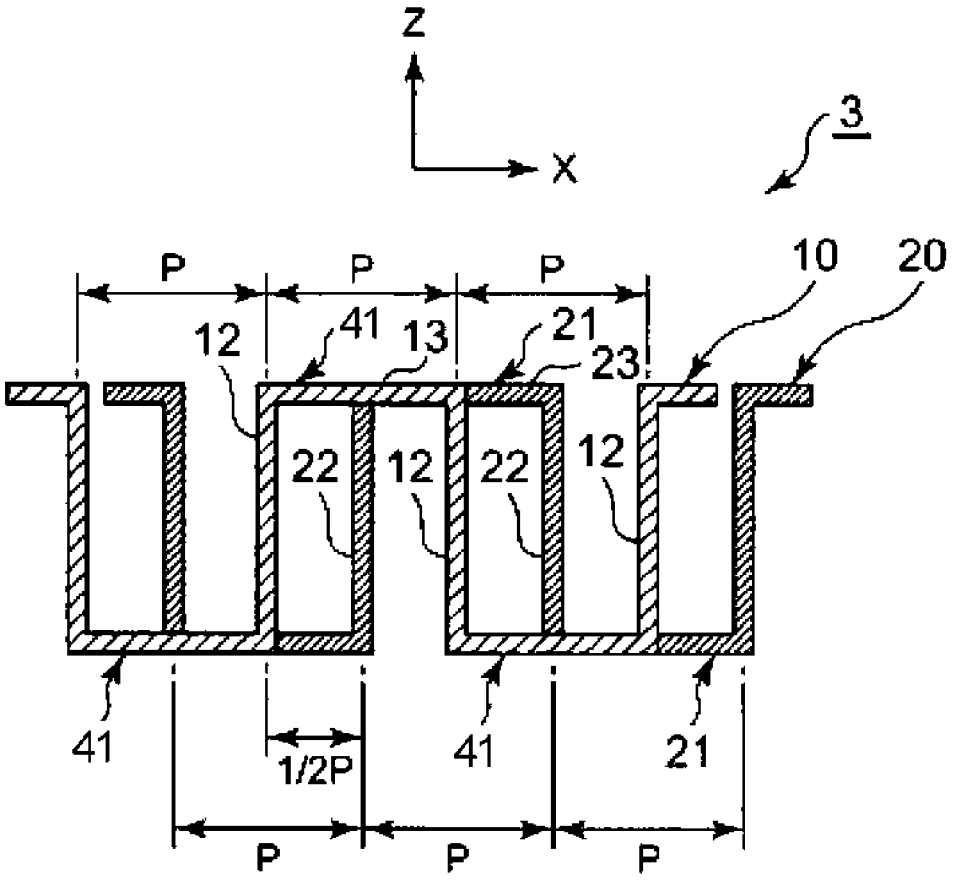
FIG. 4 is a cross-sectional view of the offset fin according to the first exemplary embodiment, taken in the XZ-plane at a location where a first corrugation structure is connected to a second corrugation structure.

FIG. 3 is a cross-sectional view of offset fin 3, taken in the XY plane of FIG. 2. FIG. 4 is a cross-sectional view of offset fin 3, taken in the XZ plane at a location (line 4-4) where corrugation structure 10 is connected to corrugation structure 20.

As illustrated in FIGS. 2 to 4, fin 41 includes a pair of side walls 12, which rise (or fall) in the Z direction, and connection wall 13 connecting edges of the pair of side walls 12 in the Z direction along the XY plane. Fin 41 is thus shaped like a gate. Similarly, fin 21 includes a pair of side walls 22, which rise (or fall) in the Z direction, and connection wall 23 connecting edges of the pair of side walls 22 in the Z direction along the XY plane.

As illustrated in FIGS. 2 and 3, side wall 12 of fin 41 is inclined at angle of inclination θ1 with respect to flow direction D1 of a fluid. Side wall 22 of fin 21 is inclined at angle of inclination θ2 with respect to flow direction D1 of a fluid. Side wall 12 and side wall 22 are inclined at opposite sides each other with respect to flow direction D1 of a fluid. For example, if the side at which side wall 12 is inclined with respect to flow direction D1 of a fluid is a positive side, the side in which side wall 22 is inclined is a negative side. In this exemplary embodiment, an absolute value of angle of inclination θ1 of side wall 12 with respect to the Y direction is identical to an absolute value of angle of inclination θ2 of side wall 22 with respect to the Y direction.

In corrugation structure 10, side walls 12 are disposed parallel to one another, and in corrugation structure 20, side walls 22 are disposed parallel to one another. That is, two adjacent side walls of fin 41 are parallel to each other, and two adjacent side walls 22 of fin 21 are parallel to each other. Side walls 12, 22 have the same height (a size in the Z direction).

As illustrated in FIG. 3, fins 41, 21 each have length L in flow direction D1 of a fluid (Y direction), pitch P in the X direction, and thickness t of side walls 12, 22. That is, the length of fin 41 in the Y direction is identical to the length of fin 21 in the Y direction. As illustrated in FIG. 4, at the location (line 4-4) where a downstream edge of corrugation structure 10 is connected to an upstream edge of corrugation structure 20, a position of an upstream edge of fin 21 in the X direction is offset by pitch P×½ from a position of a downstream edge of fin 41 in the X direction.

In other words, fins 41 and fins 21 are arranged at an equal pitch, and at a location where corrugation structure 10 faces corrugation structure 20, fins 21 are disposed offset by half the pitch from fins 41.

Offset fin 3 having the above structure can be formed by pressing a metal plate using a die, for example. Offset fin 3 may be formed of metallic material such as aluminium and stainless steel. A surface of such a metal plate may be finished and treated with, for example, a resin material.

Figure 5:
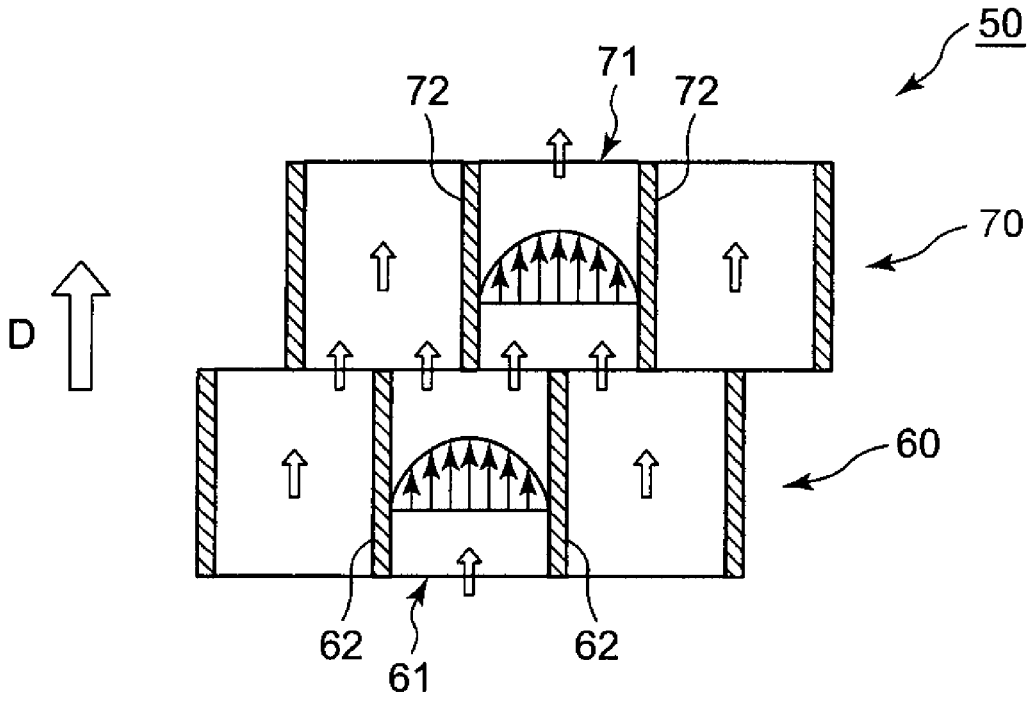
FIG. 5 is a schematic diagram illustrating a flow of fluid in a conventional offset fin.
Figure 6:
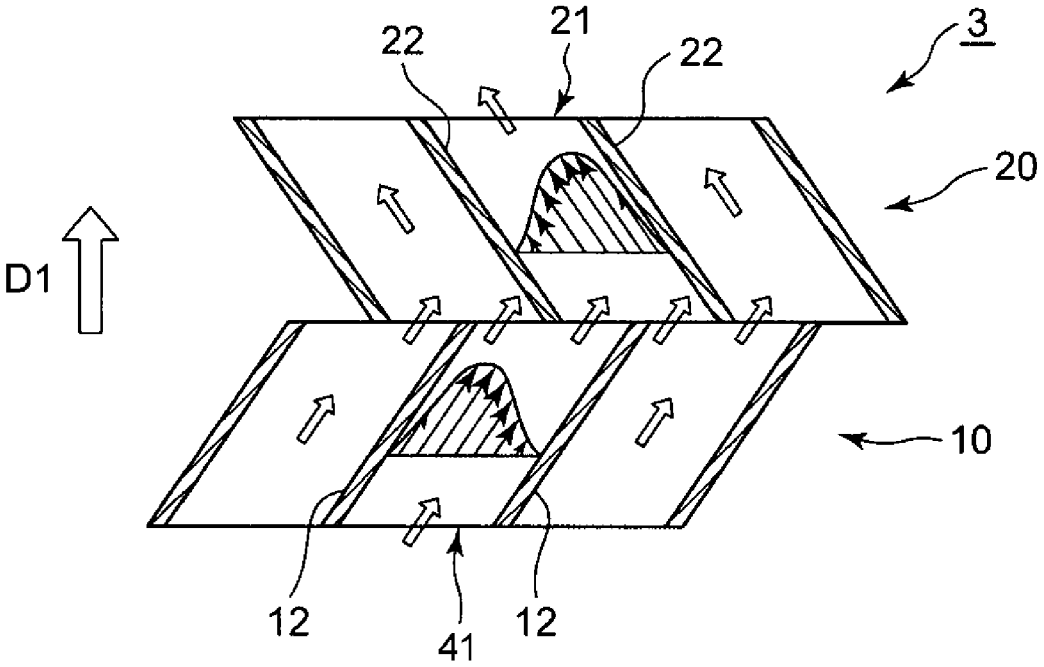
FIG. 6 is a schematic diagram illustrating a flow of fluid in the offset fin according to the first exemplary embodiment.
Figure 16:
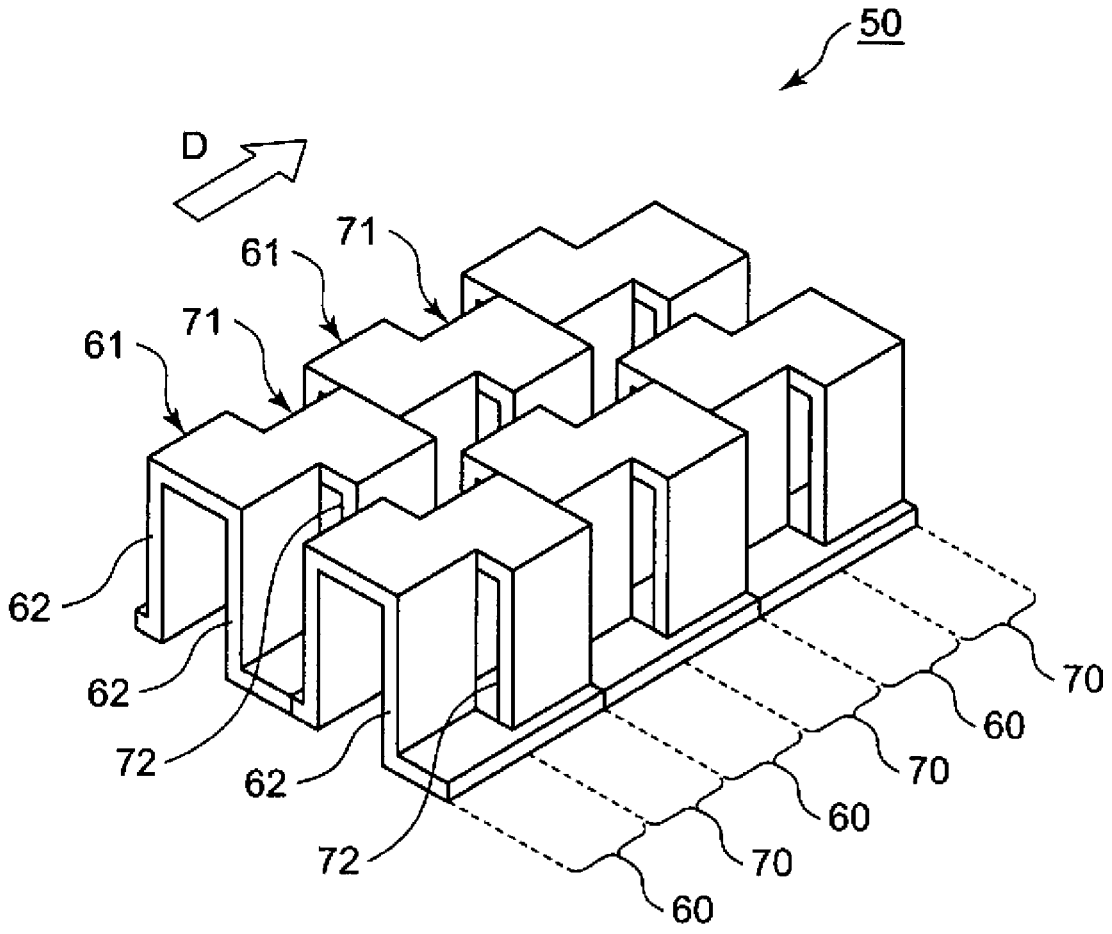
FIG. 16 is an enlarged partial perspective view of the conventional offset fin.

A flow of fluid in offset fin 3 will now be described and compared with a flow of fluid in conventional offset fin 50 illustrated in FIG. 16. FIG. 5 is a schematic diagram illustrating a flow of fluid in offset fin 50, and FIG. 6 is a schematic diagram illustrating a flow of fluid in offset fin 3.

As illustrated in FIG. 5, in offset fin 50, side walls 62, 72 of fins 61, 71 are parallel to flow direction D of a fluid. Accordingly, a fluid passage formed between side walls 62 and side walls 72 are substantially linear, allowing a fluid to flow substantially linearly in flow direction D. Consequently, the fluid flows in a substantially laminar manner, resulting in an insufficient turbulence acceleration effect produced by an offsetting. Thus, an amount of heat transferred between side walls 62, 72 and the fluid is limited.

In offset fin 3, side walls 12, 22 of fins 41, 21 are disposed inclined with respect to flow direction D1 of a fluid. A side at which side wall 12 is inclined is opposite to a side at which side wall 22 is inclined. As such, a passage formed between side walls 12 and side walls 22 are bent by angle of inclination θ1+θ2 at a location where fin 41 is connected to fin 21. Consequently, a fluid is in a turbulent state where, in the passage, a velocity of flow of the fluid in the vicinity of one side walls 12, 22 is greater than that in the vicinity of the other side walls 12, 22. Accordingly, an amount of heat transferred between side walls 12, 22 and the fluid is greater than the amount of heat transferred in the case where the fluid flows in a substantially laminar manner. That is, in addition to a turbulence acceleration effect produced by the offsetting of fins 41, 21, a further turbulence acceleration effect can be obtained by disposing side walls 12, 22 at an angle, thus increasing an amount of heat transferred.

The fluid passage where a heat transfer occurs is longer than the substantially linear fluid passage because side walls 12, 22 are inclined with respect to flow direction D1 of a fluid. Accordingly, heating surface areas of fins 41, 21, the heating surface areas contributing to a heat transfer with a fluid, are larger than heating surface areas of fins 61, 71. Consequently, a heat transfer rate of offset fin 3 is higher than a heat transfer rate of offset fin 50.

It is preferred that side wall 12 of fin 41 and side wall 22 of fin 12 be inclined at opposite sides each other with respect to flow direction D1 of a fluid, and that an angle of inclination of side wall 12 be identical to an angle of inclination of side wall 22. Microscopically, the fluid passage is inclined with respect to flow direction D1, but the fluid passage as a whole extends along flow direction D1 because the fluid passage is inclined in opposite directions alternately. As used herein, the terms "flow direction D of a fluid", and "flow direction D1 of a fluid" mean a direction in which a fluid flows when an offset fin as a whole is seen.

Examples of Offset Fin According to First Exemplary Embodiment

A plurality of analytical models (examples and comparative examples) each having the structure of offset fin 3 were created, and a simulation analysis was performed. A description will be given of an analysis examining a relationship between an angle of inclination of a side wall, an amount of heat transferred, and a pressure drop, and of a result of the analysis.

In analytical model group A, two protruding shape fins alternately disposed constitute a pattern. Passage width S1 of a pattern (i.e., pitch P×2), passage length S2, which is the sum of lengths of fin 41 and fin 21 (i.e., fin length L×2), and thickness t of side walls 12, 22 were respectively set to 2 mm, 2 mm, and 0.3 mm.

In analytical model group B, passage width S1 of a pattern, constituted by two fins, passage length S2, and thickness t of side walls 12, 22 were respectively set to 2.86 mm, 4 mm, and 0.2 mm.

In each of analytical model groups A, B, angles of inclination θ1, θ2 of side walls 12, 22 with respect to flow direction D1 of a fluid were analyzed with analytical models (A1 to A8, B1 to B8) created using eight different set values selected from 0° to 75°.

As specifications common to the analytical models, a length of a fluid passage as a whole (a length of a portion where fins are disposed) was set to 20 mm, and a linear passage was provided in front of and behind the fluid passage so as to stabilize calculation. Specifications of a material of the offset fin and of a fluid are illustrated in Table 1.

TABLE 1

| Offset fin | |
|---|---|
| Material | Aluminium |
| Density | 2730 kg/m$^3$ |
| Specific heat | 961 J/kg · K |
| Thermal conductivity | 160 W/mK |
| **Fluid (Antifreeze solution)** | |
| Reference temperature | 50° C. |
| Density | 1047 kg/m$^3$ |
| Specific heat | 3565 J/kg · K |
| Thermal conductivity | 0.416 W/mK |
| Viscocity | 0.00167 Pa · s |

The other analytical conditions are as illustrated in Table 2.

TABLE 2

| | |
|---|---|
| Fluid flow rate | 300 l/hr |
| Inlet temperature of fluid | 40° C. |
| Temperature of the other surface of passage | 69.1° C. |

Figure 7:
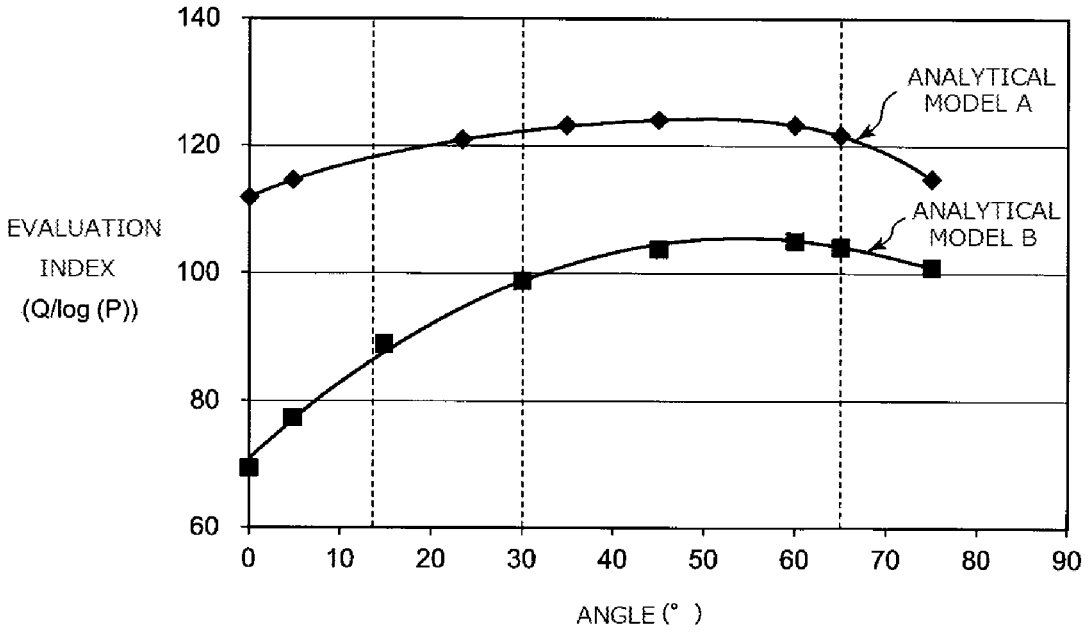
FIG. 7 is a graph illustrating a relationship between an angle of inclination of side walls and an evaluation index, the relationship based on analytical results.

Table 3 illustrates analytical results (amount of heat transferred Q (W), pressure drop P (Pa), evaluation index) obtained with the analytical models (A1 to A8, B1 to B8) based on the analytical conditions. Analytical models A1, B1, in which an angle of inclination of a side wall is 0°, are comparative examples, and other analytical models A2 to A8, B2 to B8 are examples. The evaluation index is Q/log P, which is a value obtained by dividing amount of heat transferred Q by an absolute value of a pressure drop. FIG. 7 illustrates a relationship between an angle of inclination of the side walls and an evaluation index, the relationship based on the analytical results illustrated in Table 3.

TABLE 3

| Analytical model | Passage width S1 (mm) | Passage length S2 (mm) | Plate thickness t (mm) | Angles θ1, θ2 (°) | Amount of heat transferred Q (W) | Pressure drop P (Pa) | Evaluation index Q/log (P) |
|---|---|---|---|---|---|---|---|
| A1 | 2 | 2 | 0.3 | 0 | 374.7 | 2266.3 | 111.7 |
| A2 | | | | 5 | 388.2 | 2474.2 | 114.4 |
| A3 | | | | 23.5 | 444.7 | 4804.6 | 120.8 |
| A4 | | | | 35 | 477.6 | 7558.0 | 123.1 |
| A5 | | | | 45 | 502.3 | 11529.8 | 123.7 |
| A6 | | | | 60 | 546.4 | 26706.0 | 123.4 |
| A7 | | | | 65 | 563.6 | 43110.5 | 121.6 |
| A8 | | | | 75 | 595.0 | 151920.3 | 114.8 |
| B1 | 2.86 | 4 | 0.2 | 0 | 169.9 | 281.9 | 69.3 |
| B2 | | | | 5 | 196.5 | 345.4 | 77.4 |
| B3 | | | | 15 | 240.2 | 511.5 | 88.7 |
| B4 | | | | 30 | 297.3 | 1024.6 | 98.7 |
| B5 | | | | 45 | 352.4 | 2521.3 | 103.6 |
| B6 | | | | 60 | 406.3 | 7460.5 | 104.9 |
| B7 | | | | 65 | 423.3 | 11451.6 | 104.3 |
| B8 | | | | 75 | 458.1 | 34857.8 | 100.8 |

As illustrated in Table 3 and FIG. 7, high evaluation indices are obtained with analytical models A2 to A8, B2 to B8, in which side walls are inclined, compared with evaluation indices obtained with analytical models A1, B1, in which side walls are not inclined. That is, with analytical models A2 to A8, B2 to B8, in which side walls are inclined, an increase in a pressure drop is greater than an increase in an amount of heat transferred as a result of disposing the side walls at an angle.

With a more detailed analysis, with analytical models A8, B8 (angle of inclination: 75°), the evaluation indices are greater than those obtained in the case where the angle of inclination is 0° (analytical models A1, B1), but pressure drops are significantly greater than those obtained with analytical models A7, B7 (angle of inclination: 65°). Therefore, it is preferred that for example, an angle of inclination of a side wall be set to 65° or less so that a significant increase in a pressure drop is prevented.

A small angle of a side wall increases an amount of a fluid passing without being affected by an inclined side wall, thus limiting an effect produced by the inclination of the side wall. Such an angle of inclination is related to a pitch of a passage. Therefore, it is preferred that an angle of inclination of a side wall be set considering a degree of increase in an evaluation index obtained as a result of the inclination of the side wall. FIG. 7 shows that with analytical model B, in which a passage has a larger sectional area, a smaller effect is obtained with an inclination of a side wall when an angle of inclination is significantly smaller than an angle of inclination at which a highest evaluation index is obtained. Therefore, for example, using a slope of a curve of a graph as an index (the slope obtained by approximating the curve of the graph and differentiating the approximated curve of the graph), an angle of inclination where the slope is 1 (angle of inclination: 13°) may be set as a minimum value.

Particularly, with analytical models A4, A5, A6, A7, B4, B5, B6, and B7, a high evaluation index is obtained, indicating that a higher evaluation index is obtained by setting an angle of inclination of a side wall to a value in a range from 30° to 65° inclusive.

A pressure drop increases as a result of disposing a side wall at an angle, but setting passage width S1 and a height of a side wall to large values allows a heat transfer rate to be increased while providing for a low pressure drop.

Second Exemplary Embodiment

Figure 8:
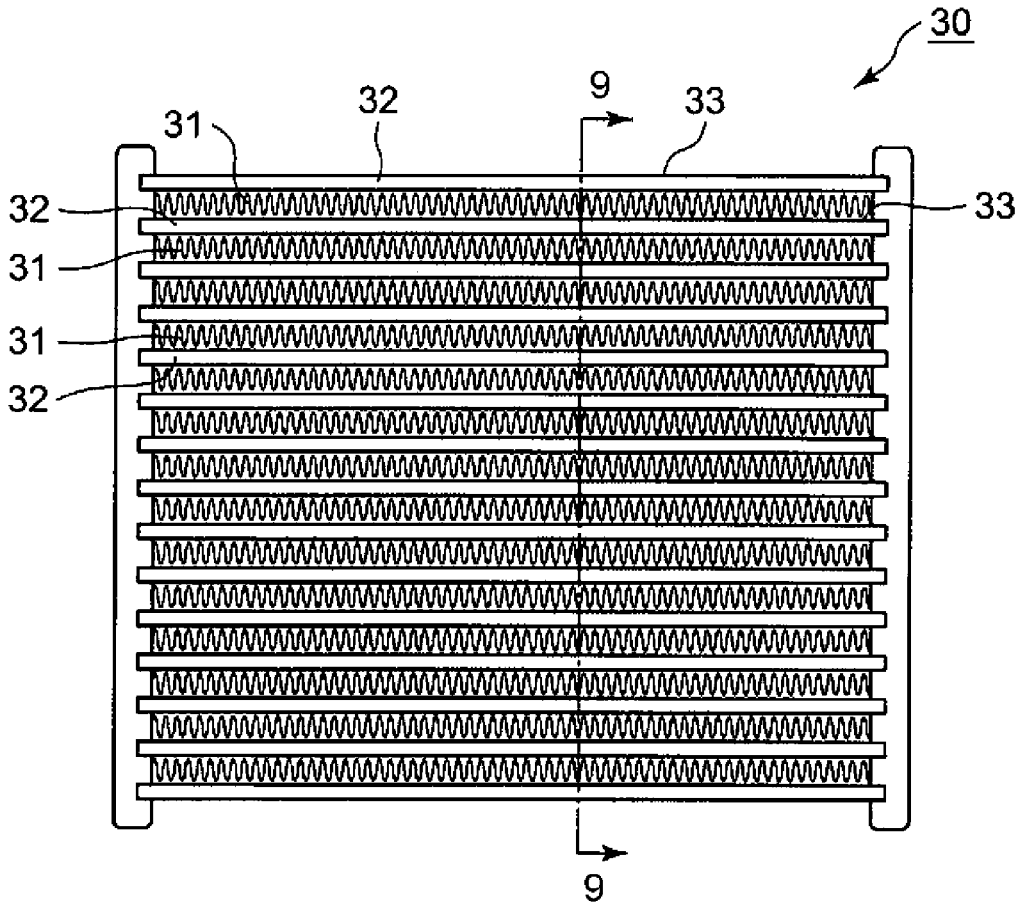
FIG. 8 is an external front view of a heat exchanger according to a second exemplary embodiment of the present disclosure.
Figure 9:
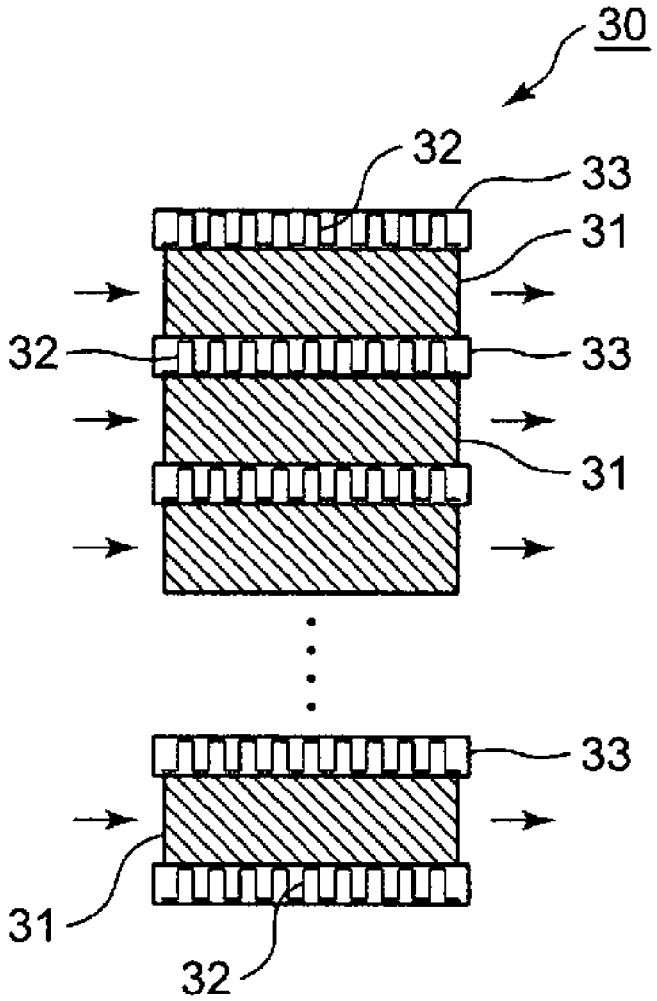
FIG. 9 is an enlarged partial schematic diagram (cross-sectional view) of the heat exchanger of FIG. 8.

A description will now be given of heat exchanger 30 according to a second exemplary embodiment of the present disclosure, heat exchanger 30 including offset fin 32. FIG. 8 is an external front view of heat exchanger 30, and FIG. 9 is an enlarged partial schematic diagram of heat exchanger 30 in FIG. 8, taken along line 9-9. Note that FIGS. 8, 9 illustrate a main structure of heat exchanger 30, so that a structure of heat exchanger 30 is partially illustrated.

As illustrated in FIG. 8, heat exchanger 30 is a finned tube heat exchanger. In heat exchanger 30, a plurality of tubes 33, in each of which offset fin 32 is disposed, and a plurality of corrugated fins 31 are alternately stacked.

Offset fin 32 is disposed inside tube 33, which defines a passage. Corrugated fin 31 is disposed between two tubes 33. A first fluid flows through a passage inside tube 33, in which offset fin 32 is disposed, and a second fluid flows through a passage defined by corrugated fin 31 between tubes 33. That is, the former passage is a first fluid passage and the latter passage is a second fluid passage. Heat is transferred between the first fluid and the second fluid via offset fin 32, tube 33, and corrugated fin 31.

Offset fin 32 has a structure similar to that of offset fin 3 according to the first exemplary embodiment. That is, in a corrugation structure of offset fin 32, a side wall of a fin is inclined with respect to a flow direction of a fluid.

As described above, also in heat exchanger 30, a heat transfer rate can be increased by using offset fin 32, which includes a side wall inclined with respect to the flow direction of a fluid.

Third Exemplary Embodiment

Figure 10:
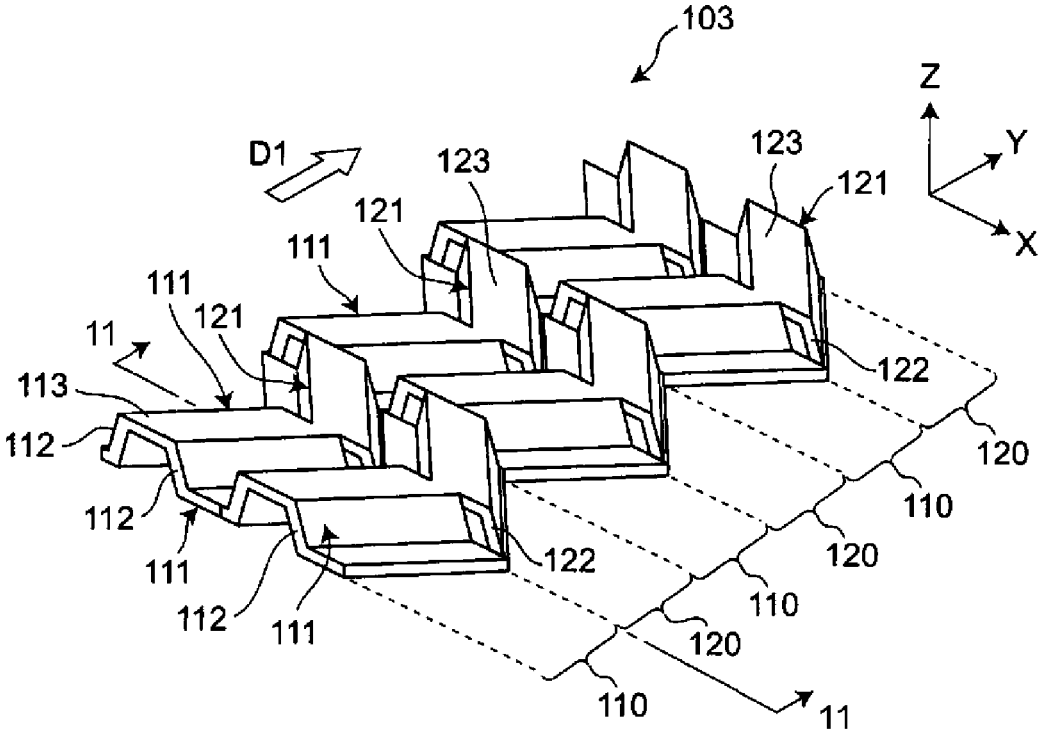
FIG. 10 is an enlarged partial perspective view of an offset fin included in a heat exchanger according to a third exemplary embodiment of the present disclosure.

A description will now be given of offset fin 103 used in a heat exchanger according to a third exemplary embodiment of the present disclosure. FIG. 10 is an enlarged partial perspective view of offset fin 103. In offset fin 3 of the first exemplary embodiment, fins 41, 21, each having a protruding shape in cross-section, respectively include a pair of side walls 12 and a pair of side walls 22, which rise (or fall) along the Z direction. Offset fin 103 differs from the first exemplary embodiment in that a pair of side walls 112, 122 rise (or fall) at an angle with respect to the Z direction. All the other structures are common to the first exemplary embodiment, and a basic structure of the heat exchanger is identical to the structure of heat exchanger 1, except that offset fin 103 is used in place of offset fin 3. The difference will be mainly described below.

As illustrated in FIG. 10, offset fin 103 includes corrugation structures 110, 120, which are positioned by bending fins 111, 121, each having a protruding shape in cross-section, toward one side and the other side of the Z direction alternately. Corrugation structures 110, 120 extend in the X direction. Offset fin 103 includes a plurality of corrugation structures 110, 120 arranged in the Y direction orthogonal to the X direction.

Figure 11:
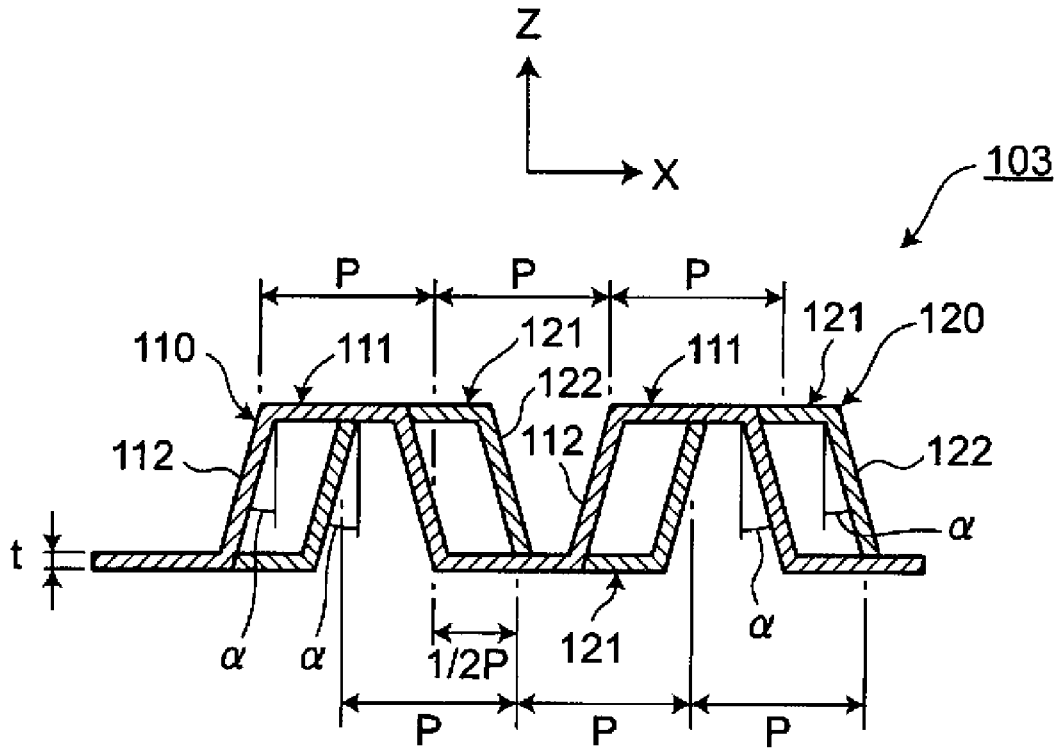
FIG. 11 is a cross-sectional view of the offset fin according to the third exemplary embodiment, taken in the XZ-plane at a location where a first corrugation structure is connected to a second corrugation structure.

FIG. 11 is a cross-sectional view of FIG. 10, taken in the XZ plane at a location (line 11-11) where corrugation structure 110 is connected to corrugation structure 120. Line 11-11 corresponds to line 4-4 of FIG. 3 in first exemplary embodiment.

As illustrated in FIGS. 10 and 11, fins 111 each have a pair of side walls 112 and connection wall 113 connecting edges of the pair of side walls 112 in the Z direction along the XY plane. Similarly, fins 121 each include a pair of side walls 122 and connection wall 123 connecting edges of the pair of side walls 122 in the Z direction along the XY plane. Fins 111, 121 are thus shaped like a gate.

As illustrated in FIG. 11, side wall 112 and side wall 122 are inclined at angle of inclination $\alpha$ with respect to the Z direction. The pair of side walls 112 and the pair of side walls 122 are inclined in opposite directions each other at the same angle of inclination $\alpha$. Specifically, fins 111, 121 each have a cross-section having a protruding shape tapered from its basal portion toward its end (where side walls 112, 121 are respectively connected to connection walls 113, 123). In the description below, angle of inclination $\alpha$ is referred to as "tapered angle $\alpha$". This exemplary embodiment is identical to the first exemplary embodiment in that side wall 112 is inclined at angle of inclination $\theta 1$ with respect to flow direction D1 of a fluid, and side wall 122 is inclined at angle of inclination $\theta 2$ with respect to flow direction D1 of a fluid. The one direction and the other direction of protruding shape fins 111, 121 included in corrugation structures 110, 120 mean the Z direction in this exemplary embodiment.

That is, offset fin 103 includes corrugation structure 110, which is a first corrugation structure, and corrugation structure 120, which is a second corrugation structure. Corrugation structure 110 includes a plurality of fins (first fins) 111 aligned in the X direction. Similarly, corrugation structure 120 includes a plurality of fins (second fins) 121 aligned in the X direction. Corrugation structure 120 is disposed in the Y direction, with respect to corrugation structure 110. Fins 111, 121 protrude alternately in the Z direction and each have a protruding shape in cross-section. In the X direction, fins 121 are disposed offset from fins 111.

Fins 111 each include a first side wall (hereinafter "side wall") 112 inclined with respect to the Y direction, and fins 121 each include a second side wall (hereinafter "side wall") 122 inclined with respect to the Y direction, at a side opposite to a side at which side wall 112 is inclined.

As illustrated in FIG. 11, the plurality of fins 111 are formed at pitch P in the X direction, and side wall 112 has thickness t. The plurality of fins 121 are similarly formed, and side wall 122 has thickness t.

At the location (line 11-11) where a downstream edge of corrugation structure 110 is connected to an upstream edge of corrugation structure 120, a position of an upstream edge of fin 121 in the X direction is offset by pitch P×½ from a position of a downstream edge of fin 111 in the X direction.

In offset fin 103, side walls 112, 122 are inclined at tapered angle $\alpha$ with respect to the Z direction. Accordingly, cross-sectional areas of fins 111, 121 in flow direction D1 (the cross-sectional areas illustrated in FIG. 11) are smaller than cross-sectional areas of fins 41, 21, which respectively have side walls 12, 22 arranged in the Z direction as in the first exemplary embodiment. The smaller cross-section in flow direction D1 reduces a pressure drop in a fluid flow. Disposing side walls 112, 122 at angle with respect to direction D1 of a fluid and with respect to the Z direction enables side walls 112, 122 to have a larger surface area which greatly contributes to a heat transfer. Accordingly, increasing a heat transfer rate is possible while preventing an increase in a pressure drop.

A tapered portion of protruding shape in cross-sections of fins 111, 121 allows a releasability of a die (i.e., ease with which a die is released) to be increased if offset fin 103 is formed by die pressing, for example, thus increasing productivity.

Examples of Offset Fin According to Third Exemplary Embodiment

A plurality of analytical models (examples and comparative examples) each having the structure of offset fin 103 were created, and a simulation analysis was performed. A description will now be given of an analysis examining a relationship between a tapered angle of a side wall, an amount of heat transferred, and a pressure drop, and of a result of the analysis.

With regard to the analytical models, analytical model B5 (angle of inclination of a side wall: 45°) in the example of the first exemplary embodiment was used as a basic model, analytical models B51 to B54, in which tapered angle α of side walls 112, 122 is set to a range from 10° to 40°, were created with respect to the basic model, and an analysis was performed. All the specifications and analytical conditions except for tapered angle cc are identical to the conditions for the analysis performed with analytical model B5.

Figure 12:
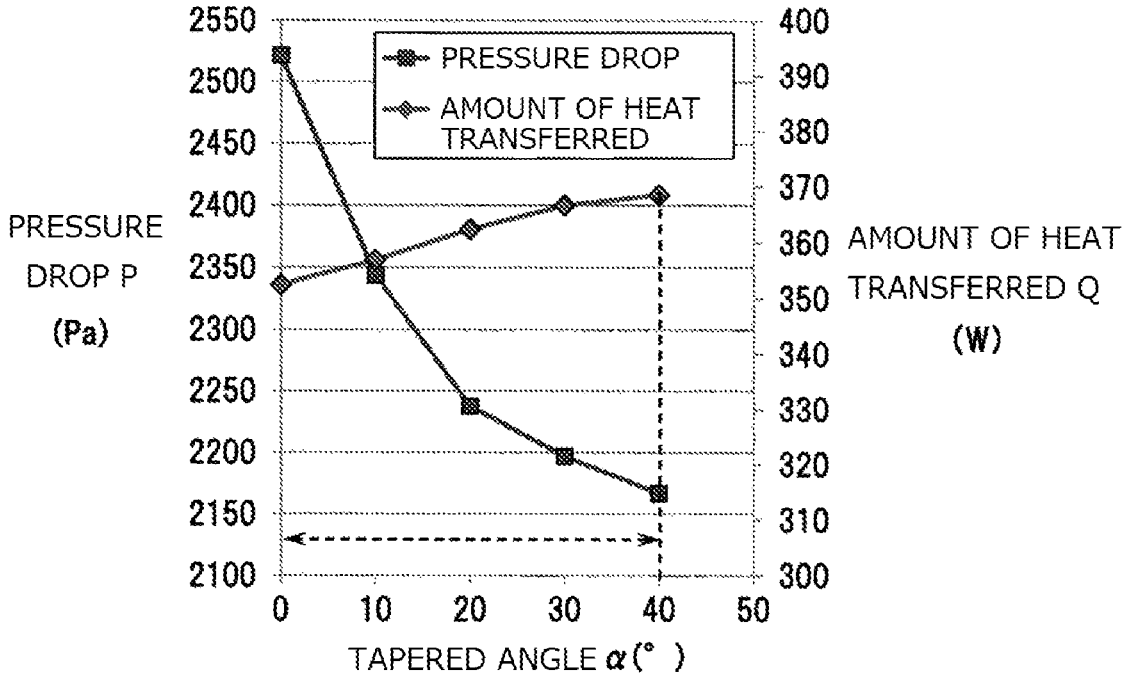
FIG. 12 is a graph illustrating a relationship between a tapered angle of a side wall, a pressure drop, and an amount of heat transferred, the relationship based on analytical results.
Figure 13:
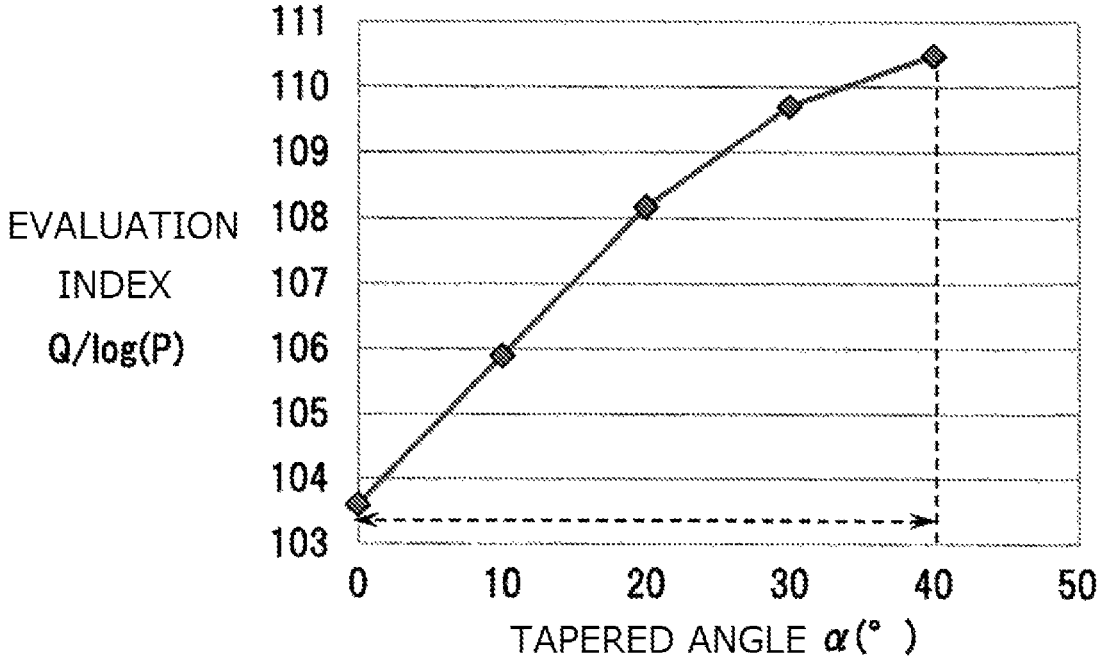
FIG. 13 is a graph illustrating a relationship between a tapered angle of side walls and an evaluation index, the relationship based on the analytical results.

Table 4 shows analytical results (amount of heat transferred Q (W), pressure drop P (Pa), evaluation index) obtained with the analytical models (B5, B51 to B54) based on the analytical conditions. These analytical models are all examples. FIG. 12 illustrates a relationship between a tapered angle α of the side walls, pressure drop P, and amount of heat transferred Q, and FIG. 13 illustrates a relationship between a tapered angle of the side walls and an evaluation index, the relationships based on the analytical results shown in Table 4.

TABLE 4

| Analytical model | Tapered angle α (°) | Amount of heat transferred Q(W) | Pressure drop P(Pa) | Evaluation index Q/log(P) |
|---|---|---|---|---|
| B5 | 0 | 352.4 | 2521.3 | 103.6 |
| B51 | 10 | 356.8 | 2343.9 | 105.9 |
| B52 | 20 | 362.3 | 2237.7 | 108.2 |
| B53 | 30 | 366.6 | 2196.7 | 109.7 |
| B54 | 40 | 368.5 | 2166.5 | 110.5 |

As illustrated in FIG. 12, with analytical models B51 to B54, in which a side wall is inclined at tapered angle α, a pressure drop is less than that obtained with analytical model B5, in which tapered angle α is 0°, i.e., a side wall is not inclined with respect to the Z direction. Particularly, the greater tapered angle α is, the lower the pressure drop is. The amount of heat transferred slightly increases with an increase in tapered angle α. FIG. 13 indicates that the larger tapered angle α is, the higher the evaluation index is. Accordingly, with an increase in tapered angle α of the side wall, the amount of heat transferred increases while the pressure drop decreases.

Figure 14:
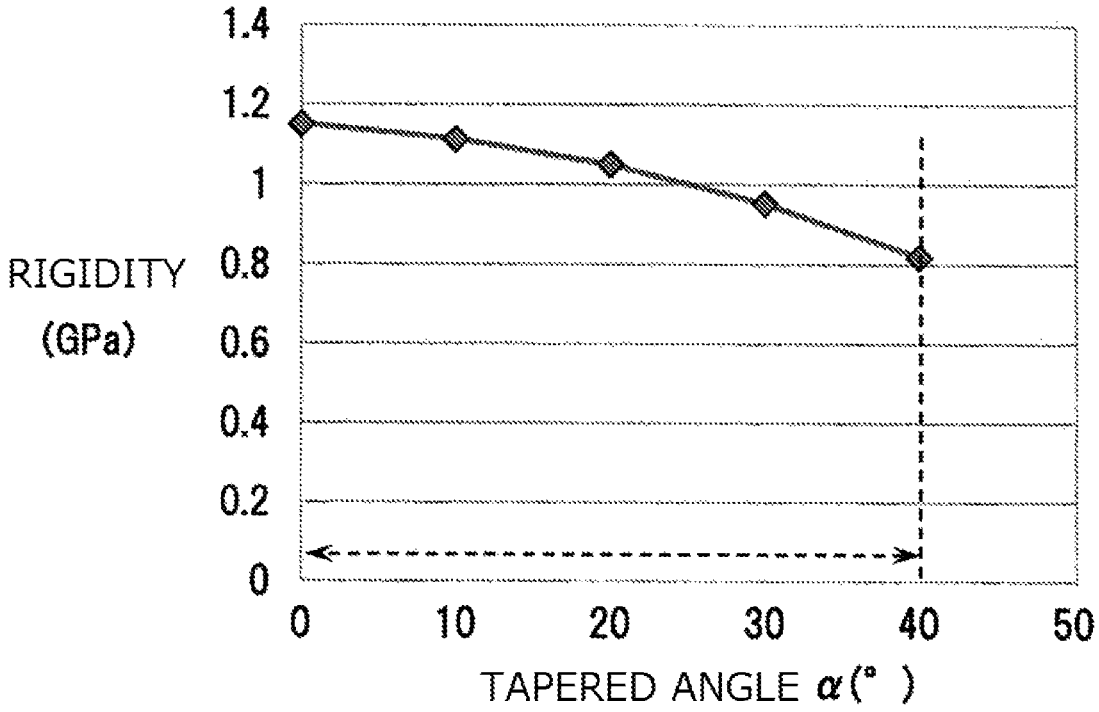
FIG. 14 is a graph illustrating a relationship between a tapered angle of a side wall and rigidity.

FIG. 14 illustrates a relationship between tapered angle α of a side wall and rigidity (equivalent rigidity (GPa (=$10^9$ Pa))) in these analytical models. Providing tapered angle α to a side wall reduces rigidity of offset fin 103 in the Z direction. However, as illustrated in FIG. 14, even with tapered angle α being 40° (analytical model B54), rigidity in the Z direction decreases by not more than 30% of that obtained with basic model B5 (α=0°). Accordingly, with tapered angle α being 40° or less, offset fin 103 has sufficient rigidity. Therefore, from the viewpoint of rigidity of offset fin 103, it is preferred that tapered angle α of a side wall be set to 40° or less. For at least 3% increase in pressure drop, it is preferred that tapered angle α be set to 5° or more.

In the description of the first exemplary embodiment, an absolute value of angle of inclination θ1 of side wall 12 included in fin 41 of corrugation structure 10 is identical to an absolute value of angle of inclination θ2 of side wall 22 included in fin 21 of corrugation structure 20. However, the present disclosure is not limited thereto. The absolute value of angle of inclination θ1 may be different from the absolute value of angle of inclination θ2 as long as side walls included in corrugation structure 10 and corrugation structure 20 are inclined at opposite sides each other with respect to flow direction D1 of a fluid.

In corrugation structure 10 and corrugation structure 20, side walls 12, 22 as a whole included in fins 41, 21 may not be inclined, but a part of side walls 12, 22 (a part of side walls 12, 22 in flow direction D1 of a fluid) may include a side wall which is not inclined. Even in that case, inclined side walls create a turbulence acceleration effect, increasing an amount of heat transferred.

Corrugation structure 10 and corrugation structure 20 are adjacent to each other in flow direction D1 of a fluid, but another structure may be interposed between corrugation structure 10 and corrugation structure 20. That is, corrugation structure 20 is only required to be disposed in the Y direction, with respect to corrugation structure 10. The another structure may be a corrugated structure in which side wall are not inclined or a corrugated structure in which side walls are inclined at angles of inclination different from each other. The turbulence acceleration effect produced by the inclined side walls can be obtained by at least disposing corrugation structure 10 and corrugation structure 20 in flow direction D1 of a fluid, thus increasing an amount of heat transferred.

A position of an upstream edge of fin 21 included in corrugation structure 20 in the X direction is offset by pitch P×½ from a position of a downstream edge of fin 41 included in corrugation structure 10 in the X direction. However, the present disclosure is not limited thereto. For example, the pitch for the offsetting may be greater than pitch P×½ or may be less than pitch P×½.

Figure 15:
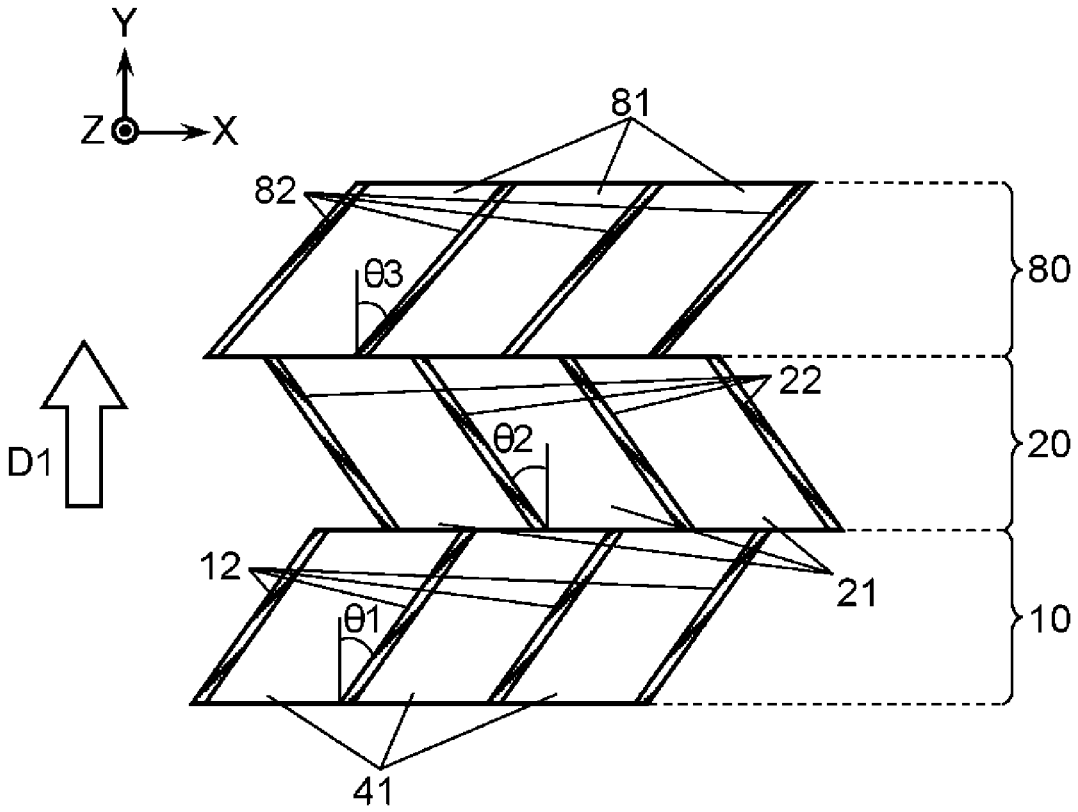
FIG. 15 is a cross-sectional view of another offset fin of the heat exchanger according to the first exemplary embodiment of the present disclosure.

A corrugation structure disposed adjacent to and downstream of corrugation structure 20 in flow direction D1 of a fluid is not limited to corrugation structure 10. As illustrated in FIG. 15, for example, a third corrugation structure (hereinafter "corrugation structure") 80, which has a structure different from that of corrugation structure 10 (e.g., a side wall has angle of inclination θ3 different from angle of inclination θ1), may be disposed adjacent to corrugation structure 20. In that case, it is preferred that in corrugation structure 20 and corrugation structure 80, side walls be inclined at opposite sides each other.

In other words, corrugation structure 80 is disposed on an opposite side of corrugation structure 10 with respect to corrugation structure 20 and includes a plurality of third fins 81 which protrude alternately in the Z direction, third fins 81 each having a protruding shape in cross-section and being aligned in the X direction. Third fins 81 each include third side wall 82 which is inclined with respect to the Y direction, in a direction opposite to a direction in which side wall 22 is inclined.

In the description of the third exemplary embodiment, side walls 112, 122 each have a flat surface inclined at tapered angle α with respect to the Z direction, but side walls 112, 122 may not be formed to have a flat surface. Side walls 112, 122 may each be curved or a portion of side walls 112, 122 may be curved as long as side walls 112, 122 as a whole are inclined at tapered angle α in the Z direction. A pair of side walls may have tapered angles α different from each other, and side walls 112, 122 may have tapered angles α different from each other. In flow direction D1 of a fluid, a corrugation structure in which a side wall is not inclined at tapered angle α, or a different structure may be interposed between corrugation structure 110 and corrugation structure 120.

Combining, as appropriate, exemplary embodiments selected from the various exemplary embodiments enables the various exemplary embodiments to achieve their effects.

A heat exchanger having the offset fin according to the present disclosure is applicable to a plate heat exchanger, a finned tube heat exchanger, a heat exchanger for emissions from an automobile, an intercooler, a radiator, a heat exchanger for air conditioning, and other industrial heat exchangers for a variety of uses.

The invention claimed is:

1. An offset fin for a heat exchanger, the offset fin comprising:

a first corrugation structure including a plurality of first fins, each of which has a protruding shape in cross-section and which are aligned in a first direction;

a second corrugation structure including a plurality of second fins, each of which has a protruding shape in cross-section and which are aligned in the first direction, the second corrugation structure being disposed in a second direction orthogonal to the first direction, with respect to the first corrugation structure; and a third corrugation structure including a plurality of third fins which protrude alternately in the third direction, the third fins each having a protruding shape in cross-section and being aligned in the first direction, the third corrugation structure being disposed on an opposite side of the first corrugation structure with respect to the second corrugation structure, wherein:

the plurality of first fins alternately protrude at opposite orientations to each other in a third direction orthogonal to both the first direction and the second direction, the plurality of second fins alternately protrude at opposite orientations to each other in the third direction, the second fins are disposed offset from the first fins along the first direction, each of the plurality of first fins includes a first side wall inclined with respect to the second direction in a range from 30° to 65° inclusive, each of the plurality of second fins includes a second side wall inclined with respect to the second direction in a range from 30° to 65° inclusive, at a side opposite to a side at which the first side wall is inclined, and the first side wall has an angle of inclination in a range from 5° to 40° with respect to the third direction, and the second side wall has an angle of inclination in a range from 5° to 40° with respect to the third direction, each of the plurality of third fins has a third side wall inclined with respect to the second direction, at a side opposite to a side at which the second side wall is inclined, and an inclination angle of each of the plurality of third fins with respect to the second direction is different from an inclination angle of each of the plurality of first fins with respect to the second direction.

2. The offset fin for a heat exchanger according to claim 1, wherein an absolute value of the angle of inclination of the first side wall with respect to the second direction is identical to an absolute value of the angle of inclination of the second side wall with respect to the second direction.

3. The offset fin for a heat exchanger according to claim 1, wherein:

the plurality of first fins are arranged at a first pitch equal to a second pitch at which the plurality of second fins are arranged, and at a location where the first corrugation structure faces the second corrugation structure, the plurality of second fins are disposed offset by half the second pitch from the plurality of first fins.

4. The offset fin for a heat exchanger according to claim 1, wherein a length of each of the plurality of first fins in the second direction is identical to a length of each of the plurality of second fins in the second direction.

5. A heat exchanger comprising:

a first fluid passage;

a second fluid passage; and the offset fin according to claim 1, the offset fin being disposed between the first fluid passage and the second fluid passage.

* * * * *